US005108660A

United States Patent [19]

Michael

[11] Patent Number: 5,108,660

[45] Date of Patent: Apr. 28, 1992

[54] HARD SURFACE LIQUID DETERGENT COMPOSITIONS CONTAINING HYDROCARBYL AMIDOALKYLENESULFOBETAINE

[75] Inventor: Daniel W. Michael, Cincinnati, Ohio

[73] Assignee: The Procter & Gamble Company, Cincinnati, Ohio

[21] Appl. No.: 628,064

[22] Filed: Dec. 21, 1990

Related U.S. Application Data

[63] Continuation-in-part of Ser. No. 471,909, Jan. 29, 1990.

[51] Int. Cl.[5] ..... C11D 1/92; C11D 3/32; C11D 3/44; B08B 3/06

[52] U.S. Cl. ..... 252/545; 252/548; 252/156; 252/158; 252/162; 252/170; 252/173; 252/DIG. 10; 252/DIG. 14; 252/364; 134/34; 134/40

[58] Field of Search ..... 252/545, 156, 170, 173, 252/164, DIG. 10, DIG. 14, 364; 134/34, 40

[56] References Cited

U.S. PATENT DOCUMENTS

| | | | |
|---|---|---|---|
| 3,417,025 | 12/1968 | Cooper et al. | 252/152 |
| 3,539,521 | 11/1970 | Snoddy et al. | 252/137 |
| 3,824,190 | 7/1974 | Winicov et al. | 252/106 |
| 4,081,395 | 3/1978 | Talley | 252/106 |
| 4,214,908 | 7/1980 | Deguchi et al. | 106/13 |
| 4,246,131 | 1/1981 | Lohr | 252/153 |
| 4,252,665 | 2/1981 | Casey et al. | 252/106 |
| 4,257,907 | 3/1981 | Lagguth et al. | 252/106 |
| 4,396,525 | 8/1983 | Rubin et al. | 252/174 |
| 4,414,128 | 11/1983 | Goffinet | 252/111 |
| 4,421,680 | 12/1983 | Shivar | 252/526 |
| 4,490,355 | 12/1984 | Desai | 424/70 |
| 4,534,964 | 11/1985 | Herstein et al. | 424/70 |
| 4,557,898 | 12/1985 | Greene et al. | 422/28 |
| 4,666,621 | 5/1987 | Clark et al. | 252/91 |
| 4,692,277 | 9/1987 | Siklosi | 252/558 |
| 4,769,169 | 9/1988 | Fishlock-Lomax | 252/106 |
| 4,769,172 | 9/1988 | Siklosi | 252/153 |
| 4,772,424 | 9/1988 | Greeb | 252/546 |
| 4,810,421 | 3/1989 | Marchesini | 252/546 |
| 4,828,849 | 5/1989 | Lynch et al. | 424/54 |
| 4,861,517 | 8/1989 | Bade | 252/546 |
| 4,948,531 | 8/1990 | Fuggini et al. | 252/544 |

OTHER PUBLICATIONS

Union Carbide Corporation, "The Hoy", 1985.

Soap Based Detergent Formulations: XII, Alternate Syntheses of Surface Active Sulfobetaines, Parris et al., J. Amer. Oil Chem. Soc., vol. 53, Feb. 1976, pp. 60–63.

Zwitterionic Surfactants: Structure and Performance, Fernly, Journal of the Oil Chemists' Society, vol. 55, Na. 1978, pp. 98–103.

*Primary Examiner*—A. Lionel Clingman

*Assistant Examiner*—Erin Higgins

*Attorney, Agent, or Firm*—Robert B. Aylor; Richard C. Witte

[57] ABSTRACT

Detergent compositions comprising a hydrocarbylamidoalkylenesulfobetaine synthetic detergent surfactant; cleaning solvent; and buffer provide superior filming/streaking and good cleaning of both glass and hard to remove greasy/oily soils. Preferred compositions contain at least one cosurfactant. The compositions can be used to clean glass without excessive spotting/filming while being sufficiently strong to be used for general cleaning purposes.

28 Claims, No Drawings

HARD SURFACE LIQUID DETERGENT COMPOSITIONS CONTAINING HYDROCARBYL AMIDOALKYLENESULFOBETAINE

CROSS-REFERENCE TO RELATED APPLICATION

This is a continuation-in-part of my copending U.S. patent application Ser. No. 04/471,909, filed Jan. 29, 1990.

FIELD OF THE INVENTION

This invention pertains to detergent compositions which contain detergent surfactants and solvents as the primary detergency materials and which are capable of being used on glass without serious spotting/filming, yet are also good for general hard surface cleaning tasks.

BACKGROUND OF THE INVENTION

The use of solvents and organic water-soluble synthetic detergents at low levels for cleaning glass are known. However, such compositions are not usually acceptable for general hard surface cleaning since they normally do not have sufficient detergency. Commonly used detergency builders, e.g., sodium and potassium, polyphosphates and pyrophosphates have been found to cause severe filming and streaking problems. An important function of builders in detergency is to sequester polyvalent metal ions (e.g., $Ca^{2+}$ and $Mg^{2+}$) in aqueous solutions of the detergent composition and without such builders, the ability of the composition to provide good cleaning is usually not satisfactory.

The object of the present invention is to provide detergent compositions which provide good cleaning for the usual general hard surface cleaning tasks found in the house including the removal of hard to remove greasy soils from counter tops and stoves and at the same time provide good glass cleaning without excessive filming and/or streaking. The advantage of having one product capable of doing both kinds of jobs is the elimination of the need to have another container stored for only an occasional job.

SUMMARY OF THE INVENTION

The present invention relates to an aqueous, hard surface detergent composition comprising: (a) hydrocarbyl-amidoalkylenesulfobetaine detergent surfactant; (b) solvent that provides a primary cleaning function and has a hydrogen bonding solubility parameter of less than about 7.7; (c) buffering system to provide a pH of from about 3 to about 13; optional, but highly preferred cosurfactant; and the balance being (d) aqueous solvent system and, optionally, minor ingredients. The composition preferably does not contain large amounts of materials like conventional detergent builders, etc. that deposit on the surface being cleaned and cause unacceptable spotting/filming. The compositions are desirably formulated at usage concentrations and even more preferably are packaged in a container having means for creating a spray to make application to hard surfaces more convenient.

DETAILED DESCRIPTION OF THE INVENTION

In accordance with the present invention, it has been found that hydrocarbyl, e.g., fatty, amidoalkylenesulfobetaines (hereinafter also referred to as "HASB"), e.g., coconut acylamidopropylene(hydroxypropylene)-sulfobetaine, where the hydroxypropylene group is between the charge centers in the molecule, are superior to conventional detergent surfactants like alkylbenzenesulfonates and alkyl sulfates and to the corresponding sulfobetaines wherein the hydrophobic group does not contain an amidoalkylene link, in tough grease removal performance, and are unexpectedly good in filming/streaking for the same level of cleaning. Best spotting/filming results are obtained with a mixture of surfactants. In addition, compositions containing the HASB are able to solubilize more and/or more hydrophobic perfumes and it is much easier to form concentrated versions of such compositions that can be diluted to form the desired compositions, even with hard water. An additional advantage of the compositions of this invention is that glass surfaces cleaned with the compositions positions have a reduced tendency to "fog-up". Yet another advantage is that soap film, and especially thin layers of soap film such as those that are commonly found on mirrors, are more readily removed than by similar compositions containing other surfactants and especially conventional anionic surfactants. The foregoing combination of advantages is unmatched by any previously known composition.

All percentages and ratios herein are "by weight" unless otherwise stated.

The Hydrocarbyl-amidoalkylenesulfobetaine Detergent Surfactant

The detergent surfactant has the generic formula:

$$R—C(O)—N(R^2)—(CR^3{}_2)_n—N(R^2)_2(+)—(CR^3{}_2)_n—SO_3(—)$$

wherein each R is a hydrocarbon, e.g., an alkyl group containing from about 8 to about 20, preferably from about 10 to about 18, more preferably from about 12 to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. These detergent surfactants are believed to provide superior grease soil removal and/or filming/streaking and/or "anti-fogging" and/or perfume solubilization properties.

A preferred detergent surfactant is a $C_{10-14}$ fatty acylamidopropylene(hydroxypropylene)sulfobetaine as set forth hereinafter. This detergent surfactant is available as a 40% active from the Sherex Company under the trade name "Varion CAS Sulfobetaine."

The level of HASB in the composition is typically from about 0.02% to about 20%, preferably from about 0.05% to about 10%, more preferably from about 0.1% to about 5%. The level in the composition is dependent on the eventual level of dilution to make the wash solution. For glass cleaning the composition, when used full strength, or wash solution containing the composition, should contain from about 0.02% to about 1%, preferably from about 0.05% to about 0.5%, more preferably from about 0.1% to about 0.25%, of the HASB. For removal of difficult to remove soils like grease, the level can, and should be, higher, typically from about 0.1% to about 10%, preferably from about 0.25% to about 2%. Concentrated products will typically contain from about 0.2% to about 10%, preferably from about 0.3% to about 5% of the HASB. As discussed hereinbefore, it is an advantage of the HASB that compositions containing it can be more readily diluted by consumers since it does not interact with hardness cations as readily as conventional anionic detergent surfactants. HASB is also extremely effective at very low levels, e.g., below about 1%.

As discussed hereinbefore, the compositions of this invention can contain more perfume and/or more hydrophobic perfumes than similar compositions containing conventional anionic detergent surfactants. This is highly desirable in the preparation of consumer products. The perfumes useful in the compositions of this invention are disclosed in more detail hereinafter.

The Cosurfactant

Compositions of this invention can also, and preferably do, contain additional organic surface-active agent ("cosurfactant") to provide additional cleaning and emulsifying benefits associated with the use of such materials and improved spotting/filming.

Cosurfactants useful herein include well-known synthetic anionic and nonionic detergent surfactants. Typical of these are the alkyl- and alkylethoxylate- (polyethoxylate) sulfates, paraffin sulfonates, olefin sulfonates, alkoxylated (especially ethoxylated) alcohols and alkyl phenols, alpha-sulfonates of fatty acids and of fatty acid esters, and the like, which are well-known from the detergency art. In general, such detergent surfactants contain an alkyl group in the $C_9$–$C_{18}$ range. The anionic detergent surfactants can be used in the form of their sodium, potassium or alkanolammonium, e.g., triethanolammonium salts; the nonionics generally contain from about 5to about 17 ethylene oxide groups. $C_{12}$–$C_{18}$ paraffin-sulfonates and alkyl sulfates are especially preferred in the compositions of the present type. When the pH is above about 9.5, detergent surfactants that are amphoteric at a lower pH are desirable anionic detergent cosurfactants. For example, detergent surfactants which are $C_{12}$–$C_{18}$ acylamido alkylene amino alkylene sulfonates, e.g., compounds having the formula $R—C(O)—(C_2H_4)—N(C_2H_4OH)—CH_2CH(OH)CH_2SO_3M$ wherein R is an alkyl group containing from about 9 to about 18 carbon atoms and M is a compatible cation are desirable cosurfactants. These detergent surfactants are available as Miranol CS, OS, JS, etc. The CTFA adopted name for such surfactants is cocoamphohydroxypropyl sulfonate. It is preferred that the compositions be substantially free of alkyl naphthalene sulfonates.

A detailed listing of suitable surfactants, of the above types, for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The cosurfactant component can comprise as little as 0.001% of the compositions herein, but typically the compositions will contain from about 0.01% to about 5%, more preferably from about 0.02% to about 2%, of cosurfactant.

The ratio of cosurfactant to HASB should be from about 1:50 to about 5:1, preferably from about 1:20 to about 2:1, more preferably from about 1:10 to about 1:2. The cosurfactant is preferably used at a lower level than the HASB.

The Solvent

In order to obtain good cleaning without any appreciable amount of detergent builder, it is necessary to use solvent that has cleaning activity. The solvents employed in the hard surface cleaning compositions herein can be any of the well-known "degreasing" solvents commonly used in, for example, the dry cleaning industry, in the hard surface cleaner industry and the metalworking industry. A useful definition of such solvents can be derived from the solubility parameters as set forth in "The Hoy," a publication of Union Carbide, incorporated herein by reference. The most useful parameter appears to be the hydrogen bonding parameter which is calculated by the formula $$\gamma H = \gamma T\left[\frac{\alpha - 1}{\alpha}\right]^{\frac{1}{2}}$$

wherein $\gamma H$ is the hydrogen bonding parameter, $\alpha$ is the aggregation number, $$\left(\text{Log } \alpha = 3.39066\ T_b/T_c - 0.15848 - \text{Log } \frac{M}{d}\right), \text{ and}$$

$\gamma T$ is the solubility parameter which is obtained from the formula $$\gamma T = \left[\frac{(\Delta H_{25} - RT)d}{M}\right]^{\frac{1}{2}}.$$

where $\Delta H_{25}$ is the heat of vaporization at 25° C., R is the gas constant (1.987 cal/mole/deg), T is the absolute temperature in °K, $T_b$ is the boiling point in °K, $T_c$ is the critical temperature in °K, d is the density in g/ml, and M is the molecular weight.

For the compositions herein, hydrogen bonding parameters are preferably less than about 7.7, more preferably from about 2 to about 7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

The level of the solvent is typically from about 0.5% to about 20%, more preferably from about 1% to about 15%, and even more preferably about 2% to about 10%.

Many of such solvents comprise hydrocarbon or halogenated hydrocarbon moieties of the alkyl or cycloalkyl type, and have a boiling point well about room temperature, i.e., above about 20° C.

The formulator of compositions of the present type will be guided in the selection of solvent partly by the need to provide good grease-cutting properties, and partly by aesthetic considerations. For example, kerosene hydrocarbons function quite well for grease cutting in the present compositions, but can be malodorous. Kerosene must e exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^1O(R^2O)_mH$ wherein each $R^1$ is an alkyl group which contains from about 3 to about 8 carbon atoms, each $R^2$ is either ethylene or propylene, and m is a number from 1 to about 3. The most preferred glycol ethers are selected from the group consisting of monopropylenemonopropyl ether, dipropyleneglycolmonobutyl ether, monopropyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to about 16 carbon atoms in their molecular structure. Preferred diol solvents have a solubility in water of from about 0.1 to about 20 g/100g of water at 20° C.

Some examples of suitable diol solvents and their solubilities in water are shown in Table 1.

TABLE 1

Solubility of Selected Diols in 20° C. Water

| Diol | Solubility (g/100 g $H_2O$) |
|---|---|
| 1,4-Cyclohexanedimethanol | 20.0* |
| 2,5-Dimethyl-2,5-hexanediol | 14.3 |
| 2-Phenyl-1,2-propanediol | 12.0* |
| Phenyl-1,2-ethanediol | 12.0* |
| 2-Ethyl-1,3-hexanediol | 4.2 |
| 2,2,4-Trimethyl-1,3-pentanediol | 1.9 |
| 1,2-Octanediol | 1.0* |

*Determined via laboratory measurements.
All other values are from published literature.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Solvents such as pine oil, orange terpene, benzyl alcohol, n-hexanol, phthalic acid esters of $C_{1-4}$ alcohols, butoxy propanol, Butyl Carbitol ® and 1(2-n-butoxy-1-methylethoxy)propane-2-ol (also called butoxy propoxy propanol or dipropylene glycol monobutyl ether), hexyl diglycol (Hexyl Carbitol ®), butyl triglycol, diols such as 2,2,4-trimethyl-1,3-pentanediol, and mixtures thereof, can be used. The butoxy-propanol solvent should have no more than about 20%, preferably no more than about 10%, more preferably no more than about 7%, of the secondary isomer in which the butoxy group is attached to the secondary atom of the propanol for improved odor.

The Buffering System

The buffering system is formulated to give a pH is use of from about 3 to about 13, preferably from about 7 to about 12, more preferably from about 9.5 to about 11.5. pH is usually measured on the product. The buffer is selected from the group consisting of: ammonia, $C_{2-4}$ alkanolamines, alkali metal hydroxides, carbonates, and/or bicarbonates, and mixtures thereof. The preferred buffering materials are ammonia and alkanolamines, especially the mono-, di-, and/or triethanolamines, and/or isopropanolamine. The buffering material in the system is important for spotting/filming. The alkanolamines are particularly good.

Preferred buffer/solvents are aminoalkanols, especially beta-aminoalkanols. Specifically, the beta-aminoalkanol compounds have the formula:

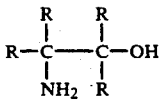

wherein each R is selected from the group consisting of hydrogen and alkyl groups containing from one to four carbon atoms and the total of carbon atoms in the compound is from three to six, preferably four. These compounds serve primarily as solvents when the pH is above about 11.0, and especially about 11.7. They also provide alkaline buffering capacity during use.

The alkanolamines are used at a level of from about 0.05% to about 15%, preferably from about 0.2% to about 10%. For dilute compositions they are typically present at a level of from about 0.05% to about 3%, preferably from about 0.1% to about 1.5%, more preferably from about 0.2% to about 0.0%. For concentrated compositions they are typically present at a level of from about 0.5% to about 15%, preferably from about 1% to about 10%.

The preferred beta-aminoalkanols have a primary hydroxy group. The amine group is preferably not attached to a primary carbon atoms. More preferably the amine group is attached to a tertiary carbon atom to minimize the reactivity of the amine group. Preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

The beta-aminoalkanols do not adversely affect spotting/filming of hard surfaces. This is especially important for cleaning of, e.g., window glass where vision is affected and for dishes and ceramic surfaces where spots are aesthetically undesirable. In addition, the beta-aminoalkanols provide superior cleaning of hard-to-remove greasy soils and superior product stability, especially under high temperature conditions.

The beta-aminoalkanols, and especially the preferred 2-amino,2-methylpropanol, are surprisingly volatile from cleaned surfaces considering their relatively high molecular weights.

The Aqueous Solvent System

The balance of the formula is typically water and, optionally, non-aqueous polar solvents with only minimal cleaning action like methanol, ethanol, isopropanol, ethylene glycol, propylene glycol, and mixtures thereof. Such solvents generally have hydrogen bonding parameters about 7.7, typically about 7.8. The level of non-aqueous polar solvent is greater when more concentrated formulas are prepared. Typically, the level of non-aqueous polar solvent is from about 0.5% to about 40%, preferably from about 1% to about 10% and the level of water is from about 50% to about 99%, preferably from about 75% to about 95%.

Optional Ingredients

The compositions herein can also contain other various adjuncts which are known to the art for detergent compositions so long as they are not used at levels that cause unacceptable spotting/filming. Nonlimiting examples of such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Antibacterial agents can be present, but preferably only at low levels to avoid spotting/filming problems. More hydrophobic antibacterial/germicidal agents, like orthobenzyl-para-chlorophenol, are avoided. If present, such materials should be kept at levels below about 0.1%.

In addition to the above ingredients, certain detergent builders that are relatively efficient for hard surface cleaners and/or, preferably, have relatively reduced filming/streaking characteristics can be included. Preferred builders are those disclosed in U.S. Pat. No. 4,769,172, Siklosi, issued Sep. 6, 1988, and incorporated herein by reference. Others include the chelating agents having the formula:

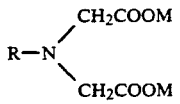

wherein R is selected from the group consisting of:

$-CH_2CH_2CH_2OH$; $-CH_2CH(OH)CH_3$;

$-CH_2CH(OH)CH_2OH$; $-CH(CH_2OH)_2$; $-CH_3$;

$-CH_2CH_2OCH_3$; $-\underset{\underset{O}{\|}}{C}-CH_3$; $-CH_2-\underset{\underset{O}{\|}}{C}-NH_2$;

$-CH_2CH_2CH_2OCH_3$; $-C(CH_2OH)_3$;

and mixtures thereof;

and each M is hydrogen or an alkali metal ion.

Chemical names of the acid form of the chelating agents herein include:

N(3-hydroxypropyl)imino-N,N-diacetic acid (3-HPIDA);

N(-2-hydroxypropyl)imino-N,N-diacetic acid (2-HPIDA);

N-glycerylimino-N,N-diacetic acid (GLIDA);

dihydroxyisopropylimino-(N,N)-diacetic acid (DHPIDA);

methylimino-(N,N)-diacetic acid (MIDA);

2-methoxyethylimino-(N,N)-diacetic acid (MEIDA);

amidoiminodiacetic acid (also known as sodium amidonitrilotriacetic, SAND);

acetamidoiminodiacetic acid (AIDA);

3-methoxypropylimino-N,N-diacetic acid (MEPIDA); and tris(hydroxymethyl)methylimino-N,N-diacetic acid (TRIDA).

Methods of preparation of the iminodiacetic derivatives herein are disclosed in the following publications:

Japanese Laid Open publication 59-70652, for 3-HPIDA;

DE-OS-25 42 708, for 2-HPIDA and DHPIDA;

Chem. ZVESTI 34(1) p. 93–103 (1980), Mayer, Riecanski et al., publication of Mar. 26, 1979, for GLIDA;

C.A. 104(6)45062 d for MIDA; and

Biochemistry 5, p. 467 (1966) for AIDA.

The chelating agents of the invention are present at levels of from about 0.1% to about 10% of the total composition, preferably about 0.2% to about 5%, more preferably from about 0.5% to about 2%. The levels of builders present in the wash solution used for glass should be less than about 0.2%. Therefore, dilution is highly preferred for cleaning glass, while full strength use is preferred for general purpose cleaning.

Other effective detergent builders, e.g., sodium citrate, sodium ethylenediaminetetraacetate, etc., can also be used, preferably at lower levels, e.g., from about 0.1% to about 1%, preferably from about 0.1% to about 0.5%.

Inclusion of a detergent builder improves cleaning, but harms spotting and filming. The incision of detergent builders therefore has to be considered as a compromise in favor of cleaning. In general, inclusion of a detergent builder is not preferred and low levels are usually more preferred than high levels. Sodium metasilicate and similar highly alkaline materials are preferably either not present, or are present only in amounts that do not raise the pH to about 12 or above.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. It is a special advantage of this invention that perfume ingredients are readily solubilized in the compositions by the acylamidoalkylene detergent surfactant. Other similar detergent surfactants will not solubilize as much perfume, especially substantive perfume, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Barin and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Normally, the art recognized perfume compositions are not very substantive as described hereinafter to minimize their effect on hard surfaces.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume materials. Also, they typically have molecular weights of about 200 or above, and are detectable at levels below those of the average perfume material.

Perfumes can also be classified according to their volatility, as mentioned hereinbefore. The highly volatile, low boiling, perfume ingredients typically have boiling points of about 250° C. of lower. Many of the more moderately volatile perfume ingredients are also lost substantially in the cleaning process. The moderately volatile perfume ingredients are those having boiling points of from about 250° C. to about 300° C. The less volatile, high boiling, perfume ingredients referred to hereinbefore are those having boiling points of about 300° C. or higher. A significant portion of even these high boiling perfume ingredients, considered to be substantive, is lost during the cleaning cycle, and it is desirable to have means to retain more of these ingredients on the dry surfaces. Many of the perfume ingredients, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-methyl acetate, menthone, iso-menthone, myrcene, myrcenyl acetate, myrcenol, nerol, neryl acetate, nonyl acetate, phenyl ethyl alcohol, alphapinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lalial (para-tertiarybutyl-alpha-methyl hydrocinnamic aldehyde), gammamethyl ionone, nerolidol, patchouli alcohol, phenyl hexanol, betaselinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gamma-2benzopyran), hexyl cinnamic aldehyde, lyral (4-(4-hydroxy-4methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by asethetic considerations, but more water soluble materials are preferred, as stated hereinbefore, since such materials are less likely to adversely affect the good spotting/filming properties of the compositions.

These compositions have exceptionally good cleaning properties. They also have good "shine" properties, i.e., when used to clean glossy surfaces, without rinsing, they have much less tendency than e.g., phosphate built products to leave a dull finish on the surface.

One surprising effect of using the compositions of this invention, is that the formation of "fog" on glass is inhibited. Apparently, the surface is modified so as to inhibit its formation. Preferred compositions do not contain any cationic material that will interfere with this effect.

In a preferred process for using the products described herein, and especially those formulated to be used at full strength, the product is sprayed onto the surface to be cleaned and then wiped off with a suitable material like cloth, a paper towel, etc. It is therefore highly desirable to package the product in a package that comprises a means for creating a spray, e.g., a pump, aerosol propellant and spray valve, etc.

The invention is illustrated by the following Examples.

EXAMPLE I

| Ingredient | Weight % |
|---|---|
| Varion CAS Sulfobetaine | 5.0 |
| Sodium Alkyl $C_{12-13}$ Benzene Sulfonate | 3.0 |
| Butoxy Propoxy Propanol | 7.0 |
| Monoethanolamine | 1.0 |
| Water and Minors | up to 100 |
| pH = 10.5 | |

EXAMPLE II

| Ingredient | Weight % |
|---|---|
| Varion CAS Sulfobetaine | 1.25 |
| Sodium $C_{12-13}$ Alkyl $(Ethoxy)_3$ Sulfate | 0.1 |
| Isopropanol | 5.0 |
| Butoxy Propanol | 2.5 |
| Monoethanolamine | 0.4 |
| Water and Minors | up to 100 |
| pH = 11.0 | |

EXAMPLE III

| Ingredient | Weight % |
|---|---|
| Varion CAS Sulfobetaine | 0.5 |
| Sodium $C_{12-13}$ Alkyl Sulfate | 0.02 |
| Ethanol | 6.0 |
| Butoxy Ethanol | 3.0 |
| Ammonium Hydroxide | 0.2 |
| Water and Minors | up to 100 |
| pH = 11.5 | |

EXAMPLE V

A liquid hard surface cleaner composition is prepared according to the following formula:

| Ingredient | Weight % |
|---|---|
| Varion CAS Sulfobetaine | 1.25 |
| Sodium $C_{13}$-$C_{15}$ Paraffin Sulfonate | 0.25 |
| $C_{12}$-$C_{14}$ Fatty Alcohol (Ethoxy)$_3$ | 0.1 |
| 1(2-n-butoxy-1-methyl ethoxy) propane-2-ol | 6.0 |
| Sodium Cumene Sulfonate | 2.0 |
| Water and Minors | up to 100 |

EXAMPLE VI

A creamy cleanser composition is prepared according to the following formula:

| Ingredient | Weight % |
|---|---|
| Varion CAS Sulfobetaine | 1.25 |
| Sodium $C_{13}$-$C_{15}$ Paraffin Sulfonate | 0.1 |
| 1(2-n-butoxy-1-methyl ethoxy) propane-2-ol | 3.0 |
| Benzyl Alcohol | 1.3 |
| Water and Minors | up to 100 |

EXAMPLE VIII

A hard surface cleaning composition especially adapted for spray-cleaning applications is prepared according to the following formula:

| Ingredient | Weight % |
|---|---|
| Varion CAS Sulfobetaine | 1.75 |
| n-Butoxy-Propanol | 7.00 |
| Ammonium Hydroxide | 0.3 |
| Water and Minors | up to 100 |

EXAMPLE IX

A hard surface cleaning composition especially adapted for spray-cleaning applications is prepared according to the following formula:

| Ingredient | Weight % |
|---|---|
| Varion CAS Sulfobetaine | 0.75 |
| n-Butoxy-Propanol | 7.00 |
| Ammonium Hydroxide | 0.4 |
| Water and Minors | up to 100 |

EXAMPLE X

A hard surface cleaning composition is prepared according to the following formula:

| Ingredient | Weight % |
|---|---|
| Varion CAS Sulfobetaine | 1.0 |
| Sodium $C_{12}$ Alcohol (EO)$_3$ Sulfate | 0.25 |
| 1(2-n-butoxy-1-methyl ethoxy) propane-2-ol | 6.5 |
| Water and Minors - Perfume, Dye and Preservatives | up to 100 |
| pH adjusted to 10.5 | |

EXAMPLE XI

A hard surface cleaning composition is prepared according to the following formula:

| Ingredient | Weight % |
|---|---|
| Varion CAS Sulfobetaine | 1.5 |
| Sodium $C_{10-14}$ Linear Alkyl Sulfate | 0.25 |
| Sodium $C_{12}$ Alcohol (EO)$_3$ Sulfate | 0.25 |
| 1(2-n-butoxy-1-methyl ethoxy) propane-2-ol | 7.0 |
| Water and Minors - Perfume, Dye and Preservatives | up to 100 |
| pH adjusted to 10.5 | |

In the Examples, the following tests were used to evaluate the products' performance.

Preparation of Soiled Panels

Enamel splash panels are selected and cleaned with a mild, light duty liquid cleanser, then cleaned with isopropanol, and rinsed with distilled or deionized water. A specified amount (0.5–0.75 gram per plate) of greasy-particulate soil is weighed out and placed on a sheet of aluminum foil. The greasy-particulate soil is a mixture of about 77.8% commercial vegetable oils and about 22.2% particulate soil composed of humus, fine cement, clay, ferrous oxide, and carbon black. The soil is spread out with a spatula and rolled to uniformity with a standard 3-inch wide, one quarter inch nap, paint roller. The uniform soil is then roller onto the clean enamel panels until an even coating is achieved. The panels are then placed in a preheated oven and baked at 130°–150° C. for 35–50 minutes. Panels are allowed to cool to room temperature and can either be used immediately, or aged for one or more days. The aging produces a tougher soil that typically requires more cleaning effort to remove.

Soil Removal

A Gardner Straight Line Washability Machine is used to perform the soil removal. The machine is fitted with a carriage which holds the weighted cleaning implement. The cleaning implements used for this testing were clean cut sponges. Excess water is wrung out from the sponge and 1.0–3.0 grams of product are uniformly applied to one surface of the sponge. The sponge is fitted into the carriage on the Gardner machine and the cleaning test is run.

Cleaning Scale Rating Method

This method evaluates the cleaning efficiently of various products and compares them to some reference product. The number of Gardner machine strokes necessary to achieve 95–99% removal of soil are obtained. Then the following formula is used to calculate a product's scale rating.

"Soil Removal" Scale Rating =

-continued $$\frac{1}{\text{\# strokes for test product}} \times 100 \times \text{\# strokes for reference product}$$

This yields a value of 100 for the reference product, and if test product requires fewer strokes than the standard it will have a Scale Rating value >100, if the test product requires more strokes than the standard it will have a Scale Rating value <100.

Filming/Streaking Test on Glass Panels

A glass window pane approximately 18 inch×23 inch is cleaned with a mild detergent to remove any accumulated soil. It is then cleaned repeatedly with a solvent blend of isopropanol and propylene glycol monobutylether until no visible residue remains on the glass. The glass is then divided into four equal sized quadrants with masking tape. Two milliliters of each test product are uniformly applied to a quartered paper towel and applied to a specific quadrant. The wet paper towel is rubbed uniformly throughout the quadrant and the residue is allowed to evaporate.

Panel Score Unit Grading Method

Expert judges are called upon to compare two quadrants for the relative amount of filming/streaking. A numerical value is assigned to represent the judges filming/streaking grade. The following scale is used.

0: No difference in filming/streaking
1: I think there is a difference in filming/streaking
2: I know there is a difference in filming/streaking
3: There is a large difference in filming/streaking
4: There is a very large difference in filming/streaking "+" or "−" signs are applied to non-zero ratings to indicate if the first quadrant listed is superior (+) or inferior (−) to the second quadrant of the pair.

EXAMPLE XII

| Ingredient | Formula No. 1 Wt. % | 2 Wt. % | 3 Wt. % | 4 Wt. % |
|---|---|---|---|---|
| Propylene Glycol Monobutylether | 6.0 | 6.0 | 6.0 | 6.0 |
| Isopropanol | 3.0 | 3.0 | 3.0 | 3.0 |
| Ammonia | 0.12 | 0.12 | 0.12 | 0.12 |
| Sodium Alkyl Sulfate ($\sim C_{13}$) | 0.20 | — | — | 0.02 |
| Sodium Docdecylbenzene Sulfonate | — | 0.20 | — | — |
| Ethoxylated Fatty Alcohol ($\sim C_{10}$, $E_6$) | — | — | 0.20 | — |
| Cocoamidopropyl-dimethyl-2-hydroxy-3-sulfopropyl-betaine | — | — | — | 0.18 |
| Perfume | 0.20 | 0.20 | 0.20 | 0.20 |
| Deionized Water | q.s. | q.s. | q.s. | q.s. |

All pH's adjusted to about 10.7.

Soil Removal Scale Rating Data (Six replications, soiled panels aged one day)

| Formula No. | Mean Rating |
|---|---|
| 1 | 66 |
| 2 | 60 |
| 3 | 40 |
| 4 | 100 |

The least significant difference between mean ratings is 14 at 95% confidence interval.

EXAMPLE XIII

| Ingredient | Formula No. 1 Wt. % | 2 Wt. % | 3 Wt. % | 4 Wt. % |
|---|---|---|---|---|
| Propylene Glycol Monobutylether | 6.0 | 6.0 | 6.0 | 6.0 |
| Isopropanol | 3.0 | 3.0 | 3.0 | 3.0 |
| Ammonia | 0.12 | 0.12 | 0.12 | 0.12 |
| Sodium Alkyl Sulfate ($\sim C_{13}$) | 0.20 | — | — | — |
| Lauryl-dimethyl-ammonium-3-sulfopropyl Betaine | — | 0.20 | — | — |
| Lauryl-dimethyl-ammonium-2-hydroxy-3-sulfopropylbetaine | — | — | 0.20 | — |
| Cocoamidopropyl-dimethyl-ammonium-2-hydroxy-3-sulfopropylbetaine | — | — | — | 0.20 |
| Perfume | 0.085 | 0.085 | 0.085 | 0.085 |
| Deionized Water | q.s. | q.s. | q.s. | q.s. |

All pH's adjusted to about 10.5.

Soil Removal Scale Rating Data (Three replications)

| Formula No. | Mean Rating |
|---|---|
| 1 | 60 |
| 2 | 76 |
| 3 | 70 |
| 4 | 100 |

The least significant difference between mean ratings is 8 at 95% confidence interval. Formulas 2 and 3 are clearly better than the standard Formula 1, but are clearly inferior to Formula 4 which contains the preferred sulfobetaine that has an amidoalkylene linkage in the hydrophobic group.

EXAMPLE XIV

| Ingredient | Formula No. 1 Wt. % | 2 Wt. % | 3 Wt. % | 4 Wt. % |
|---|---|---|---|---|
| Propylene Glycol Monobutylether | 6.0 | 6.0 | 6.0 | 6.0 |
| Isopropanol | 3.0 | 3.0 | 3.0 | 3.0 |
| Ammonia | 0.12 | 0.12 | 0.12 | 0.12 |
| Sodium Alkyl Sulfate ($\sim C_{13}$) | 0.20 | — | — | 0.02 |
| Sodium Dodecylbenzene Sulfonate | — | 0.20 | — | — |
| Ethoxylated Fatty Alcohol ($\sim C_{10}$, $E_6$) | — | — | 0.20 | — |
| Cocoamidopropyl-dimethyl-2-hydroxy-3-sulfopropyl-betaine | — | — | — | 0.18 |
| Perfume | 0.20 | 0.20 | 0.20 | 0.20 |
| Deionized Water | q.s. | q.s. | q.s. | q.s. |

All pH's adjusted to about 10.7.

Filming/Streaking on Glass Panels
Panel Score Unit (psu) Ratings (Four replications)

| Formula Pair | Mean psu Rating |
|---|---|
| 1 versus 4 | −0.42 |
| 2 versus 4 | −1.42s |

-continued

| Filming/Streaking on Glass Panels Panel Score Unit (psu) Ratings (Four replications) | |
|---|---|
| Formula Pair | Mean psu Rating |
| 3 versus 4 | −3.83s |

An "s" indicates a statistically significant difference at >90% confidence. Formula 4, containing the amidoalkylene sulfobetaine, is either superior to, or equal to, Formulas containing conventional surfactants in filming/streaking while having the superior cleaning performance demonstrated in Examples XII and XIII.

| | Formula No. | |
|---|---|---|
| Ingredient | 1 Wt. % | 2 Wt. % |
| Propylene Glycol Monobutylether | 6.0 | 6.0 |
| Isopropanol | 3.0 | 3.0 |
| Ammonia | 0.12 | 0.12 |
| Sodium Alkyl Sulfate (~$C_{13}$) | 0.10 | — |
| Sodium Alkyl Ethoxylated Sulfate (~$C_{13}$, $E_3$) | 0.10 | — |
| Cocoamidopropyl-dimethyl-2-hydroxy-3-sulfopropylbetaine | — | 0.20 |
| Perfume | 0.20 | 0.20 |
| Water (with 9 grains of hardness as $CaCO_3$) | q.s. | q.s. |

Both pH's adjusted to about 10.7.

| Filming/Streaking on Glass Panels Panel Score Units Ratings (Four replications) | |
|---|---|
| Formula Pair | Mean psu Rating |
| 1 versus 2 | −2.17s |

An "s" indicates a statistically significant difference at >90% confidence. The data is a continuation of the data in Example XIV and demonstrates the overall superiority of amidoalkylenesulfobetaine surfactants for hard surface cleaning of glass that usually requires specialized formulations.

EXAMPLE XVI

| Ingredient | Weight % |
|---|---|
| Varion CAS Sulfobetaine | 0.15 |
| Miranol CS* | 0.05 |
| n-Butoxy-Propanol | 2.00 |
| Ethanol | 4.00 |
| Monoethanolamine | 0.40 |
| Water and Minors pH adjusted to 11.0 | up to 100 |

*Cocoamphohydroxypropylsulfonate

What is claimed is:

1. An aqueous hard surface detergent composition comprising: (a) from about 0.02% to about 20% by weight of hydrocarbyl-amidoalkylenesulfobetaine detergent surfactant; (b) from about 0.5% to about 20% by weight of solvent that has a hydrogen bonding parameter of less than about 7.7; (c) buffering system to provide a pH of from about 3 to about 13; and (d) the balance being an aqueous solvent system comprising water and optionally, a nonaqueous polar solvent having a hydrogen bonding parameter about 7.8.

2. The composition of claim 1 containing at least one cosurfactant, the ratio of cosurfactant to said hydrocarbyl-amido-alkylenesulfobetaine being from about 1:50 to about 5:1.

3. The composition of claim 2 wherein said cosurfactant is an anionic detergent surfactant.

4. The composition of claim 2 wherein said cosurfactant is selected from the group consisting of $C_{12}$–$C_{18}$ alkyl sulfates, $C_{12}$–$C_{18}$ paraffin sulfonates, $C_{12}$–$C_{18}$ acylamidoalkylene amino alkylene sulfonate at a pH of more than about 9.5, and mixtures thereof.

5. The composition of claim 1 containing sufficient buffering to maintain a pH of from about 7 to about 12.

6. The composition of claim 5 wherein the pH is from about 9.5 to about 11.5.

7. The composition of claim 1 wherein said solvent (b) comprises from about 0.5% to about 20% by weight of an organic solvent having a hydrogen bonding parameter of from about 2 to about 7.

8. The composition of claim 7 wherein said solvent (b) comprises from about 1% to about 15% of organic solvent having a hydrogen bonding parameter of from about 3 to about 6.

9. The composition of claim 7 wherein said solvent (b) is selected from the group consisting of alkyl and cycloalkyl hydrocarbons and halohydrocarbons, alpha olefins, benzyl alcohol, pine oil, glycol ethers, and diols containing 6 to 16 carbon atoms.

10. The composition of claim 9 wherein said solvent (b) is a diol containing from about 8 to about 12 carbon atoms.

11. The composition of claim 1 wherein said solvent (b) is 2,2,4-trimethyl-1,3-pentanediol.

12. The composition of claim 7 said solvent (b) contains from about 1% to about 15% of an organic solvent having the formula $R^1O(R^2O)_mH$ wherein each $R^1$ is an alkyl group which contains from about 3 to about 8 carbon atoms, each $R^2$ is selected from the group consisting of ethylene or propylene, and m is a number from 1 to about 3.

13. The composition of claim 12 wherein said solvent (b) is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

14. The composition of claim 1 wherein said hydrocarbyl-amidoalkylenesulfobetaine (a) has the formula:

$$R—C(O)—N(R^2)—(CR^3{}_2)_n—N(R^2)_2(+)—(CR^3{}_2)_n—SO_3(-)$$

wherein each R is an alkyl group containing from about 10 to about 18 carbon atoms, each ($R^2$) is selected from the group consisting of hydrogen, methyl, ethyl, propyl, hydroxy substituted ethyl or propyl and mixtures thereof, each ($R^3$) is selected from the group consisting of hydrogen and hydroxy groups, and each n is a number from 1 to about 4; with no more than about one hydroxy group in any ($CR^3{}_2$) moiety.

15. The composition of claim 14 wherein said R group contains from about 9 to about 15 carbon atoms, the $R^2$ on the amido nitrogen is hydrogen, each $R^2$ on the quaternary nitrogen is methyl, one of the $R^3$ groups between the (+) and the (−) charge centers is a hydroxy group and the remaining $R^3$ groups are hydrogen, and each n is 3.

16. The composition of claim 14 containing at least one cosurfactant, the ratio of cosurfactant to said hydrocarbyl-amidoalkylenesulfobetaine being from about 1:50 to about 5:1.

17. The composition of claim 16 wherein said cosurfactant is an anionic detergent surfactant.

18. The composition of claim 16 wherein said cosurfactant is selected from the group consisting of $C_{12}$–$C_{18}$ alkyl sulfates, $C_{12}$–$C_{18}$ paraffin sulfonates, $C_{12}$–$C_{18}$ acylamidoalkylene amino alkylene sulfonate at a pH of more than about 9.5, and mixtures thereof.

19. The composition of claim 16 containing sufficient buffering to maintain a pH of from about 9.5 to about 11.5.

20. The composition of claim 14 wherein said solvent (b) comprises from about 0.5% to about 20% by weight of an organic solvent having a hydrogen bonding parameter of from about 2 to about 7.

21. The composition of claim 20 wherein said solvent (b) comprises from about 1% to about 15% by weight of organic solvent having a hydrogen bonding parameter of from about 3 to about 6.

22. The composition of claim 14 wherein said solvent (b) is selected from the group consisting of alkyl and cycloalkyl hydrocarbons and halohydrocarbons, alpha olefins, benzyl alcohol, pine oil, glycol ethers, and diols containing 6 to 16 carbon atoms.

23. The composition of claim 14 said solvent (b) contains from about 1% to about 15% of an organic solvent having the formula $R^1O(R^2O)_mH$ wherein each $R^1$ is an alkyl group which contains from about 3 to about 8 carbon atoms, each $R^2$ is selected from the group consisting of ethylene or propylene, and m is a number from 1 to about 3.

24. The composition of claim 14 wherein said solvent (b) is selected from the group consisting of monopropylenemonopropyl ether, dipropyleneglycolmonobutyl ether, monopropyleneglycolmonobutyl ether, diethyleneglycolmonohexyl ether, monoethyleneglycolmonohexyl ether, and mixtures thereof.

25. The composition of claim 1 packaged in a package that comprises a means for creating a spray.

26. The process of cleaning hard surfaces comprising spraying said surfaces with the composition of claim 25.

27. The process of claim 26 wherein the composition has a concentration of component (a) in water of from about 0.02% by weight to about 1% and the hard surface is glass.

28. An aqueous hard surface detergent composition comprising: (a) from about 0.02% to about 20% by weight of hydrocarbyl-amidoalkylenesulfobetaine detergent surfactant; (b) from about 0.5% to about 20% by weight of solvent that has a hydrogen bonding parameter of less than about 7.7; (c) buffering system to provide a pH of from about 3 to about 13; and (d) the balance being an aqueous solvent system comprising water and, optionally, a nonaqueous polar solvent having a hydrogen bonding parameter above 7.8, said composition being substantially free of alkyl naphthalene sulfonates.

* * * * *

US005108660A

REEXAMINATION CERTIFICATE (1992nd)

United States Patent [19]

[11] B1 5,108,660

Michael

[45] Certificate Issued Apr. 27, 1993

[54] HARD SURFACE LIQUID DETERGENT COMPOSITIONS CONTAINING HYDROCARBYL-AMIDOALKYLENE-SULFOBETAINE

[75] Inventor: Daniel W. Michael, Cincinnati, Ohio

[73] Assignee: The Procter & Gamble Company, Cincinnati, Ohio

Reexamination Request:
No. 90/002,772, Jul. 2, 1992

Reexamination Certificate for:

| | |
|---|---|
| Patent No.: | **5,108,660** |
| Issued: | **Apr. 28, 1992** |
| Appl. No.: | **628,064** |
| Filed: | **Dec. 21, 1990** |

Related U.S. Application Data

[63] Continuation-in-part of Ser. No. 471,909, Jan. 29, 1990.

[51] Int. Cl.[5] ..... C11D 1/92; C11D 3/32; C11D 3/44; B08B 3/06

[52] U.S. Cl. ..... 252/545; 252/548; 252/156; 252/158; 252/162; 252/170; 252/173; 252/DIG. 10; 252/DIG. 14; 252/364; 134/34; 134/40

[58] Field of Search ..... 252/545, 548, 156, 158, 252/162, 170, 173, DIG. 10, DIG. 14, 364; 134/34, 40

[56] References Cited

U.S. PATENT DOCUMENTS

| | | | |
|---|---|---|---|
| 3,280,179 | 10/1966 | Ernst | 260/501 |
| 3,309,321 | 3/1967 | McMaster | 252/152 |
| 3,649,569 | 3/1972 | McCarty | 252/543 |
| 3,696,043 | 10/1972 | Labarge et al. | 252/153 |
| 3,755,559 | 8/1973 | Hewitt | 424/70 |
| 3,840,480 | 10/1974 | Barrat et al. | 252/545 |
| 3,842,847 | 10/1974 | Hewitt et al. | 132/7 |
| 3,849,548 | 11/1974 | Grand | 424/70 |
| 3,928,065 | 12/1975 | Savino | 134/7 |
| 3,928,251 | 12/1975 | Bolich, Jr. et al. | 252/545 |
| 3,935,130 | 1/1976 | Hirano et al. | 252/542 |
| 3,950,417 | 4/1976 | Verdicchio et al. | 252/545 |
| 3,962,418 | 6/1976 | Birkofer | 424/70 |
| 4,110,263 | 8/1978 | Lindemann et al. | 252/545 |
| 4,122,043 | 10/1978 | Kersnar et al. | 252/527 |
| 4,148,762 | 4/1979 | Koch et al. | 252/544 |
| 4,181,634 | 1/1980 | Kennedy et al. | 252/545 |
| 4,186,113 | 1/1980 | Verdicchio et al. | 252/526 |
| 4,233,192 | 11/1980 | Lindemann et al. | 252/545 |
| 4,259,217 | 3/1981 | Murphy | 252/547 |
| 4,261,869 | 4/1981 | Bishop et al. | 252/542 |
| 4,265,782 | 5/1981 | Armstrong et al. | 252/174.19 |
| 4,299,739 | 11/1981 | Esposito et al. | 252/545 |
| 4,329,334 | 5/1982 | Su et al. | 424/70 |
| 4,329,335 | 5/1982 | Su et al. | 424/70 |
| 4,372,869 | 2/1983 | Lindemann et al. | 252/174.16 |
| 4,414,128 | 11/1983 | Goffinet | 252/111 |
| 4,420,484 | 12/1983 | Gorman et al. | 424/326 |
| 4,438,096 | 3/1984 | Preston | 424/70 |
| 4,443,362 | 4/1984 | Guth et al. | 252/545 |
| 4,450,091 | 5/1984 | Schmolka | 252/174.21 |
| 4,452,732 | 6/1984 | Bolich, Jr. | 252/547 |
| 4,477,365 | 10/1984 | Verboom et al. | 252/156 |
| 4,485,029 | 11/1984 | Kato et al. | 252/106 |
| 4,529,588 | 7/1985 | Smith et al. | 424/70 |
| 4,554,098 | 11/1985 | Klisch et al. | 252/547 |
| 4,654,207 | 3/1987 | Preston | 424/70 |
| 4,673,523 | 6/1987 | Smith et al. | 252/91 |
| 4,683,008 | 7/1987 | Betts | 134/27 |
| 4,772,424 | 9/1988 | Greeb | 252/546 |
| 4,784,786 | 11/1988 | Smith et al. | 252/91 |
| 4,913,841 | 4/1990 | Zeman | 252/352 |
| 4,921,629 | 5/1990 | Malihi et al. | 252/170 |
| 5,015,412 | 5/1991 | Zeman | 252/311 |
| 5,061,393 | 10/1991 | Linares et al. | 252/143 |

FOREIGN PATENT DOCUMENTS

| | | | |
|---|---|---|---|
| 88168 | 9/1982 | Australia . | |
| 706408 | 3/1965 | Canada | 260/309.6 |
| 706409 | 3/1965 | Canada | 260/309.6 |
| 0004755 | 10/1979 | European Pat. Off. . | |
| 0024031A1 | 2/1981 | European Pat. Off. . | |
| 0040882A2 | 12/1981 | European Pat. Off. . | |
| 0067635A2 | 12/1982 | European Pat. Off. . | |
| 0106266A2 | 4/1984 | European Pat. Off. . | |
| 0117135A2 | 8/1984 | European Pat. Off. . | |
| 0157443 | 10/1985 | European Pat. Off. . | |
| 0181212 | 5/1986 | European Pat. Off. . | |
| 0205626A1 | 12/1986 | European Pat. Off. . | |
| 0338850 | 10/1989 | European Pat. Off. . | |
| 0373851A2 | 6/1990 | European Pat. Off. . | |

| | | |
|---|---|---|
| 0408174A1 | 1/1991 | European Pat. Off. . |
| 274332A3 | 12/1989 | Fed. Rep. of Germany . |
| 275046A1 | 1/1990 | Fed. Rep. of Germany . |
| 48-60706 | 8/1973 | Japan . |
| 59-189197 | 10/1984 | Japan . |
| 60-141797 | 7/1985 | Japan . |
| 60-161498 | 8/1985 | Japan . |
| 60-195200 | 10/1985 | Japan . |
| 61-009500 | 1/1986 | Japan . |
| 61-014296 | 1/1986 | Japan . |
| 61-014298 | 1/1986 | Japan . |
| 62-252499 | 11/1987 | Japan . |
| 62-257992 | 11/1987 | Japan . |
| 63-012333 | 1/1988 | Japan . |
| 1-092298 | 4/1989 | Japan . |
| 1-135898 | 5/1989 | Japan . |
| 1-153796 | 6/1989 | Japan . |
| 1-221496 | 9/1989 | Japan . |
| 1-221497 | 9/1989 | Japan . |
| 2-269200 | 2/1990 | Japan . |
| 2-145697 | 6/1990 | Japan . |
| 2-155996 | 6/1990 | Japan . |
| 2-296899 | 12/1990 | Japan . |
| 3-111494 | 5/1991 | Japan . |
| 3-115495 | 5/1991 | Japan . |
| 3-153797 | 7/1991 | Japan . |
| 3-163052 | 7/1991 | Japan . |
| 3-215410 | 9/1991 | Japan . |
| 3-258900 | 11/1991 | Japan . |
| WO91/09104 | 6/1991 | PCT Int'l Appl. . |
| WO91/13610 | 9/1991 | PCT Int'l Appl. . |
| WO91/15192 | 10/1991 | PCT Int'l Appl. . |
| 84944 | 10/1984 | Romania . |
| 1544563 | 4/1979 | United Kingdom . |
| 2193505A | 2/1988 | United Kingdom . |

OTHER PUBLICATIONS

N. Parris et al., "Soap Based Detergent Formulations. V. Amphoteric Lime Soap Dispersing Agents," JAOCS, 50(1973) pp. 509-512.

W. R. Noble et al., "Soap-Based Detergent Formulations: X. Nature of Detergent Deposits," JAOCS, 52(1975) pp. 1-4.

N. Parris et al., "Soap-Based Detergent Formulations: XII. Alternate Syntheses of Surface Active Sulfobetaines," JAOCS, 53(1976) pp. 60-63.

F. D. Smith et al., "Soap-Based Detergent Formulations: XV. Amino Esters of alpha-Sulfo Fatty Acids," JAOCS, 53(1976) pp. 69-72.

Parris et al., "Soap-Based Detergent Formulations: XVIII. Effect of Structure Variations on Surface-Active Properties of Sulfur Containing Amphoteric Surfactants," JAOCS, 53(1976) pp. 97-100.

J. K. Weil et al., "Soap-Based Detergent Formulations: XX. The Physical and Chemical Nature of Lime Soap Dispersions," JAOCS, 53(1976) pp. 757-761.

J. K. Weil et al., "The Mutual Solubilization of Soap and Lime Soap Dispersing Agents," JAOCS, 54(1977) pp. 1-3.

T. J. Micich et al., "Soap-Based Detergent Formulations: XIX. Amphoteric Alkylsuccinamide Derivatives as Lime Soap Dispersants," JAOCS, 54(1977) pp. 91-94.

T. J. Micich et al., "Soap-Based Detergent Formulations: XXII. Sulfobetaine Derivatives of N-Alkylglutaramides and Adipamides," JAOCS, 54(1977) pp. 264-266.

N. Parris et al., "Soap Based Detergent Formulation: XXIV. Sulfobetaine Derivatives of Fatty Amides," JAOCS, 54(1977), pp. 294-296.

J. K. Weil et al., "Surface Active Properties of Combinations of Soap and Lime Soap Dispersing Agents," JAOCS, 54(1976) pp. 339-342.

J. M. Kaminski et al., "Soap-Based Detergent Formulations: XXIII. Synthesis of p-Sulfobenzyl Ammonium Inner Salts and Structural Correlation with Analogous Amphoterics," JAOCS, 54(1977) pp. 516-520.

F. D. Smith et al., "Soap-based Detergent Formulations: XXI. Amphoteric Derivatives of Fatty Amides of Aminoethylethanolamine," JAOCS, 55(1978) pp. 741-744.

J. M. Kaminski et al., "Soap-Based Detergent Formulations: XXV. Synthesis and Surface Active Properties of Higher Molecular Weight Betaine Lime Soap Dispersants," JAOCS, 56(1979) pp. 771-774.

W. M. Linfield, "Soap and Lime Soap Dispersants," JAOCS, 55(1978), pp. 87-92.

W. R. Noble et al., "Soap-based Detergent Formulations: XXVI. Hard Water Detergency of Soap-lime Soap Dispersant Combinations with Builders and Inorganic Salts," JAOCS, 57(1980), pp. 368-372.

J. G. Weers et al., "Effect of the intramolecular charge separation distance on the solution properties of betaines and sulfobetaines," Langmuir, 1991, vol. 7(5), pp. 854-867. (Abstract only).

T. Takeda et al., "Synthesis and properties of a,w-bis-(amidopropylhydroxysulfobetaine)-type amphoteric surfactants," Yukagaku, 1990, vol. 39(8), pp. 576-579. (Abstract only).

Chem. Abstract 102(22):190818t—P. Busch et al., "Hair-conditioning effect of guar hydroxypropyl--trimethylammonium chloride. Part I.", Parfuem. Kosmet. 1984 65(11), 692, 694-6, 698.

Chem. Abstract 102(22):190819u—P. Busch et al., "Hair-conditioning effect of guar hydroxypropyl--trimethylammonium chloride. Part 2.", Parfuem. Kosmet. 1984 65(12), 756, 758-60.

Chem. Abstract 108(1):5366g—C. A. Bunton, "Micellar effects on nucleophilicity," Adv. Chem. Ser. 1987, 215(Nucleophilicity), 425-41.

Chem. Abstract 115(6):56929v—CTFA, Inc., "Final report on the safety assessment of cocamidopropyl betaine," J. Am. Coll. Toxicol. 1991, 10(1). 33-52.

Chem. Abstract 115(4):138653q—V. Allikmaa, "Highly efficient reversed-phase HPLC studies of amphoteric and cationic amido group-containing surfactants," Eesti Tead. Akad. Toim., Keem 1991, 40(1), 67-72.

*Primary Examiner*—Paul Lieberman

[57] ABSTRACT

Detergent compositions comprising a hydrocarbylamidoalkylenesulfobetaine synthetic detergent surfactant; cleaning solvent; and buffer provide superior filming/streaking and good cleaning of both glass and hard to remove greasy/oily soils. Preferred compositions contain at least one cosurfactant. The compositions can be used to clean glass without excessive spotting/filming while being sufficiently strong to be used for general cleaning purposes.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 43 and 51-52:

Cosurfactants useful herein include well-known synthetic anionic and nonionic detergent surfactants. Typical of these are the alkyl- and alkylethoxylate- (polyethoxylate) sulfates, paraffin sulfonates, olefin sulfonates, alkoxylated (especially ethoxylated) alcohols and alkyl phenols, alpha-sulfonates of fatty acids and of fatty acid esters, and the like, which are well-known from the detergency art. In general, such detergent surfactants contain an alkyl group in the $C_9$–$C_{18}$ range. The anionic detergent surfactants can be used in the form of their sodium, potassium or alkanolammonium, e.g., triethanolammonium salts; the nonionics generally contain from about [5to] *5 to* about 17 ethylene oxide groups. $C_{12}$–$C_{18}$ paraffin-sulfonates and alkyl sulfates are especially preferred in the compositions of the present type. When the pH is above about 9.5, detergent surfactants that are amphoteric at a lower pH are desirable anionic detergent cosurfactants. For example, detergent surfactants which are $C_{12}$–$C_{18}$ acylamido alkylene amino alkylene sulfonates, e.g., compounds having the formula [$R—C(O)—(C_2H_4)—N(C_2H_4OH)—CH_2CH(OH)CH_2SO_3M$] $R—C(O)—N(C_2H_4OH)—CH_2CH(OH)CH_2SO_3M$ wherein R is an alkyl group containing from about 9 to about 18 carbon atoms and M is a compatible cation are desirable cosurfactants. These detergent surfactants are available as Miranol CS, OS, JS, etc. The CTFA adopted name for such surfactants is cocoamphohydroxypropyl sulfonate. It is preferred that the compositions be substantially free of alkyl naphthalene sulfonates.

Column 4, line 65:

Many of such solvents comprise hydrocarbon or halogenated hydrocarbon moieties of the alkyl or cycloalkyl type, and have a boiling point well [about] *above* room temperature, i.e., above about 20° C.

Column 5, line 5:

The formulator of compositions of the present type will be guided in the selection of solvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would [e] *be* more likely to select solvents which have a relatively pleasant odor, or odors which can be reasonably modified by perfuming.

Column 6, line 6:

The buffering system is formulated to give a pH [is] *in* use of from about 3 to about 13, preferably from about 7 to about 12, more preferably from about 9.5 to about 11.5. pH is usually measured on the product. The buffer is selected from the group consisting of: ammonia, $C_{2-4}$ alkanolamines, alkali metal hydroxides, carbonates, and/or bicarbonates, and mixtures thereof. The preferred buffering materials are ammonia and alkanolamines, especially the mono-, di-, and/or triethanolamines, and/or isopropanolamine. The buffering material in the system is important for spotting/filming. The alkanolamines are particularly good.

Column 8, lines 20-21:

Methods of preparation of the iminodiacetic derivatives herein are disclosed in the following publications:

Japanese Laid Open publication 59-70652, for 3-HPIDA;

DE-OS-25 42 708, for 2-HPIDA and DHPIDA;

Chem. ZVESTI 34(1) p. 93-103 (1980), Mayer, [Riecanski] *Riecanska* et al., publication of Mar. 26, 1979, for GLIDA;

C.A. 104(6)45062 d for MIDA; and

Biochemistry 5, p. 467 (1966) for AIDA.

Column 8, line 28:

The chelating agents of the invention are present at levels of from about 0.1% to about 10% of the total composition, preferably about 0.2% to about 5%, more preferably from about 0.5% to about 2%. The levels of [builders] *builder* present in the wash solution used for glass should be less than about 0.2%. Therefore, dilution is highly preferred for cleaning glass, while full strength use is preferred for general purpose cleaning.

AS A RESULT OF REEXAMINATION, IT HAS BEEN DETERMINED THAT:

Claims 1, 14 and 28 are determined to be patentable as amended.

Claims 2-13 and 15-27, dependent on an amended claim, are determined to be patentable.

New claims 29-44 are added and determined to be patentable.

1. An aqueous hard surface detergent composition comprising: (a) from about 0.02% to about 20% by weight of hydrocarbyl-amidoalkylenesulfobetaine detergent surfactant *having the formula:*

$$R—C(O)—N(R^2)—(CR^3{}_2)_n—N(R^2)_2(+)—(CR^3{}_2)_n—SO_3(-)$$

*wherein each R is an alkyl group containing from about 8 to about 18 carbon atoms, each* ($R^2$) *is selected from the group consisting of hydrogen, methyl, ethyl, propyl, hydroxy substituted ethyl or propyl and mixtures thereof, each* ($R^3$) *is selected from the group consisting of hydrogen and hydroxy groups, at least one of the* $R^3$ *groups between the* (+) *and the* (−) *charge centers is a hydroxy group, and each n is a number from 1 to about 4; with no more than about 1 hydroxy group in any* ($CR^3{}_2$) *moiety*; (b) from about 0.5% to about 20% by weight of solvent that has a hydrogen bonding parameter of less than about 7.7 *and more than about 2*; (c) buffering system to provide a pH of from about 3 to about 13; [and] (d) *optional cosurfactant for (a) selected from the group consisting of anionic detergent surfactant, nonionic detergent surfactant, and mixtures thereof; and* (e) the balance being an aqueous solvent system comprising water and optionally, a nonaqueous polar solvent having a hydrogen bonding parameter [about] *above* 7.8, *the ratio of any cosurfactant that is present to said hydrocarbyl-amido-alkylenesulfobetaine being less than about 5:1.*

14. The composition of claim 1 wherein said hydrocarbyl-aminoalkylenesulfobetaine (a) has the formula:

$$R—C(O)—N(R^2)—(CR^3{}_2)_n—N(R^2)_2(+)—(CR^3{}_2)_n—SO_3(-)$$

wherein each R is an alkyl group containing from about 10 to about 18 carbon atoms, each ($R^2$) is selected from the group consisting of hydrogen, methyl, ethyl, propyl, hydroxy substituted ethyl or propyl and mixtures thereof, each ($R^3$) is selected from the group consisting of hydrogen and hydroxy groups, *at least one of the $R^3$ groups between the (+) and the (−) charge centers is a hydroxy group,* and each n is a number from 1 to about 4; with no more than about one hydroxy group in any ($CR^3{}_2$) moiety.

28. An aqueous hard surface detergent composition comprising: (a) from about 0.02% to about 20% by weight of hydrocarbyl-amidoalkylenesulfobetaine detergent surfactant *having the formula:*

$$R—C(O)—N(R^2)—(CR^3{}_2)_n—N(R^2)_2(+)—(CR^3{}_2)_n—SO_3(-)$$

*wherein each R is an alkyl group containing from about 8 to about 18 carbon atoms, each ($R^2$) is selected from the group consisting of hydrogen, methyl, ethyl, propyl, hydroxy substituted ethyl or propyl and mixtures thereof, each ($R^3$) is selected from the group consisting of hydrogen and hydroxy groups, at least one of the $R^3$ groups between the (+) and the (−) charge centers is a hydroxy group, and each n is a number from 1 to about 4; with no more than about 1 hydroxy group in any ($CR^3{}_2$) moiety;* (b) from about 0.5% to about 20% by weight of solvent that has a hydrogen bonding parameter of *more than about 2 and* less than about 7.7; (c) buffering system to provide a pH of from about 3 to about 13; and (d) the balance being an aqueous solvent system comprising water and, optionally, a nonaqueous polar solvent having a hydrogen bonding parameter above 7.8, said compositions being substantially free of alkyl naphthalene sulfonates.

*29. An aqueous hard surface detergent composition comprising: (a) from about 0.02% to about 20% by weight of hydrocarbyl-amido-alkylenesulfobetaine detergent surfactant having the formula:*

$$R—C(O)—N(R^2)—(CR^3{}_2)_n—N(R^2)_2(+)—(CR^3{}_2)_n—SO_3(-)$$

*wherein each R is an alkyl group containing from about 8 to about 18 carbon atoms, each ($R^2$) is selected from the group consisting of hydrogen, methyl, ethyl, propyl, hydroxy substituted ethyl or propyl and mixtures thereof, each ($R^3$) is selected from the group consisting of hydrogen and hydroxy groups, at least one of the $R^3$ groups between the (+) and the (−) charge centers is a hydroxy group, and each n is a number from 1 to about 4; with no more than about 1 hydroxy group in any ($CR^3{}_2$) moiety; (b) from about 0.5% to about 20% by weight of propylene glycol monobutyl ether; (c) buffering system to provide a pH of from about 3 to about 13; and (d) the balance being an aqueous solvent system comprising water and a nonaqueous polar solvent having a hydrogen bonding parameter above 7.8 and, optionally, (e) a cosurfactant for (a) selected from the group consisting of anionic detergent surfactant, nonionic detergent surfactant, and mixtures thereof the ratio of any cosurfactant that is present to said hydrocarbyl-amidoalkylenesulfobetaine being less than about 5:1.*

*31. The composition of claim 30 wherein said R groups contains from about 9 to about 15 carbon atoms, each $R^2$ is methyl, one of the $R^3$ groups between the (+) and the (−) charge centers is a hydroxy group and the remaining $R^3$ groups are hydrogen, and each n is 3.*

*32. The composition of claim 30 containing at least one cosurfactant wherein said cosurfactant is an anionic detergent surfactant.*

*33. The composition of claim 30 wherein said cosurfactant is selected from the group consisting of $C_{12}$–$C_{18}$ alkyl sulfates, $C_{12}$–$C_{18}$ paraffin sulfonates, $C_{12}$–$C_{18}$ acylamidoalkylene amido alkylene sulfonate at a pH of more than about 9.5, and mixtures thereof.*

*34. The composition of claim 30 containing sufficient buffering to maintain a pH of from about 9.5 to about 11.5.*

*35. The composition of claim 29 packaged in a package that comprises a means for creating a spray.*

*36. An aqueous hard surface detergent composition capable of being used on glass without serious spotting/filming while being sufficiently strong to be used for general cleaning purposes, consisting essentially of: (a) from about 0.02% to about 20% by weight of hydrocarbyl-amidoalkylenesulfobetaine detergent surfactant having the formula:*

$$R—C(O)—N(R^2)—(CR^3{}_2)_n—N(R^2)_2(+)—(CR^3{}_2)_n—SO_3(-)$$

*wherein each R is an alkyl group containing from about 8 to about 18 carbon atoms, each ($R^2$) is selected from the group consisting of hydrogen, methyl, ethyl, propyl, hydroxy substituted ethyl or propyl and mixtures thereof, each ($R^3$) is selected from the group consisting of hydrogen and hydroxy groups, at least one of the $R^3$ groups between the (+) and the (−) charge centers is a hydroxy group, and each n is a number from 1 to about 4; with no more than about 1 hydroxy group in any ($CR^3{}_2$) moiety; (b) from about 0.5% to about 20% by weight of solvent that has a hydrogen bonding parameter of less than about 7.7 and more than about 2; (c) buffering system to provide a pH of from about 3 to about 13; (d) from 0% to about 5% of cosurfactant selected from the group consisting of anionic detergent surfactant, nonionic detergent surfactant, and mixtures thereof; (e) from 0% to about 5% of detergent builder; and (f) the balance being an aqueous solvent system comprising water and optionally, a nonaqueous polar solvent having a hydrogen bonding parameter above 7.8, the ratio of any cosurfactant that is present to said hydrocarbyl-amido-alkylenesulfobetaine being less than about 5:1.*

*37. The composititon of claim 36 wherein said R group contains from about 9 to about 15 carbon atoms, each $R^2$ is methyl, one of the $R^3$ groups between the (+) and the (−) charge centers is a hydroxy group and the remaining $R^3$ groups are hydrogen, and each n is 3.*

*38. The composition of claim 36 containing at least one cosurfactant wherein said cosurfactant is an anionic detergent surfactant.*

*39. The composition of claim 36 wherein said cosurfactant is selected from the group consisting of $C_{12}$–$C_{18}$ alkyl sulfates, $C_{12}$–$C_{18}$ paraffin sulfonates, $C_{12}$–$C_{18}$ acylamidoalkylene amido alkylene sulfonate at a pH of more than about 9.5, and mixtures thereof.*

*40. The composition of claim 36 containing sufficient buffering to maintain a pH of from about 9.5 to about 11.5.*

*41. An aqueous hard surface detergent composition capable of being used on glass without serious spotting-/filming while being sufficiently strong to be used for general cleaning purposes, consisting essentially of: (a) from about 0.02% to about 1% by weight of hydrocarbyl-amidoalkylenesulfobetaine detergent surfactant having the formula:*

$$R—C(O)—N(R^2)—(CR^3{}_2)_n—N(R^2)_2(+)—(CR^3{}_2)_n—SO_3(-)$$

*wherein each R is an alkyl group containing from about 8 to about 18 carbon atoms, each ($R^2$) is selected from the group consisting of hydrogen, methyl, ethyl, propyl, hydroxy substituted ethyl or propyl and mixtures thereof, each ($R^3$) is selected from the group consisting of hydrogen and hydroxy groups, at least one of the $R^3$ groups between the (+) and the (−) charge centers is a hydroxy group, and each n is a number from 1 to about 4; with no more than about 1 hydroxy group in any ($CR^3{}_2$) moiety; (b) from about 0.5% to about 20% by weight of solvent that has a hydrogen bonding parameter of less than about 7.7 and more than about 2; (c) buffering system to provide a pH of from about 3 to about 13; and (d) the balance being an aqueous solvent system comprising water and optionally, a nonaqueous polar solvent having a hydrogen bonding parameter above 7.8, and also optionally, a cosurfactant selected from the group consisting of anionic detergent surfactant, nonionic detergent surfactant, and mixtures thereof in addition to said hydrocarbyl-amidoalkylenesulfobetaine the ratio of said cosurfactant to said hydrocarbyl-amidoalkylenesulfobetaine being less than about 2.1.*

42. The composition of claim 41 containing from about 0.05% *to about 0.5% by weight of said hydrocarbyl-amidoalkylenesulfobetaine detergent surfactant; wherein said pH is from about 7 to about 12; and wherein said ratio of cosurfactant to said hydrocarbyl-amidoalkylenesulfobetaine is less than about 1:2.*

*43. An aqueous hard surface detergent composition capable of being used on glass without serious spotting/filming while being sufficiently strong to be used for general cleaning purposes, consisting essentially of: (a) from about 0.02% to about 20% by weight of hydrocarbyl-amidoalkylenesulfobetaine detergent surfactant having the formula:*

$$R—C(O)—N(R^2)—(CR^3{}_2)_n—N(R^2)_2(+)—(CR^3{}_2)_n—SO_3(-)$$

*wherein R is an alkyl group containing from about 8 to about 18 carbon atoms, each ($R^2$) is selected from the group consisting of hydrogen, methyl, ethyl, propyl, hydroxy substituted ethyl or propyl and mixtures thereof, each ($R^3$) is selected from the group consisting of hydrogen and hydroxy groups, at least one of the $R^3$ groups between the (+) and the (−) charge centers is a hydroxy group, and each n is a number from 1 to about 4; with no more than about 1 hydroxy group in any ($CR^3{}_2$) moiety; (b) from about 0.5% to about 20% by weight of solvent selected from the group consisting of: (1) solvent having the formula $R^1O(R^2O)_mH$ wherein each $R^1$ is an alkyl group which contains from about 3 to about 8 carbon atoms, each $R^2$ is selected from the group consisting of ethylene or propylene, and m is a number of from 1 to about 3; (2) diols having from 6 to about 16 carbon atoms in their molecular structure and a solubility in water of from about 0.1 to about 20 g/100 g of water at 20° C.; (3) benzyl alcohol; (4) n-hexanol; (5) phthalic acid esters of $C_{1-4}$ alcohols; (6) pine oil; and (7) mixtures thereof; (c) buffering system to provide a pH of from about 3 to about 13; (d) from 0% to about 5% of cosurfactant selected from the group consisting of anionic detergent surfactant, nonionic detergent surfactant, and mixtures thereof; (e) from 0% to about 5% of detergent builder; and (f) the balance being an aqueous solvent system comprising water and optionally, a nonaqueous polar solvent having a hydrogen bonding parameter above 7.8, the ratio of any cosurfactant that is present to said hydrocarbyl-amidoalkylenesulfobetaine being less than about 5:1.*

*44. The composition of claim 43 wherein said R group contains from about 9 to about 15 carbon atoms, each $R^2$ is methyl, one of the $R^3$ groups between the (+) and the (−) charge centers is a hydroxy group and the remaining $R^3$ groups are hydrogen, and each n is 3.*

* * * * *